US005094168A

United States Patent [19]

Rumer

[11] Patent Number: 5,094,168

[45] Date of Patent: Mar. 10, 1992

[54] CAMOUFLAGE AND DECEPTION ARRANGEMENT

[75] Inventor: Klaus Rumer, Hersbruck, Fed. Rep. of Germany

[73] Assignee: Diehl GmbH & Co., Nüremberg, Fed. Rep. of Germany

[21] Appl. No.: 705,307

[22] Filed: May 24, 1991

[30] Foreign Application Priority Data

May 25, 1990 [DE] Fed. Rep. of Germany ..... 4016854

[51] Int. Cl.[5] ..... C06D 6/00; F41H 9/06

[52] U.S. Cl. ..... 102/334; 89/1.1; 89/1.11

[58] Field of Search ..... 89/1.1, 1.11, 36.01; 102/334; 342/8, 10

[56] References Cited

U.S. PATENT DOCUMENTS

| | | | |
|---|---|---|---|
| 1,100,529 | 6/1914 | Brubaker | 102/334 |
| 1,336,557 | 4/1920 | Benner et al. | 102/334 |
| 2,426,822 | 9/1947 | Fonos | 252/319 |
| 3,432,439 | 3/1969 | Dickman | 102/334 |
| 4,307,665 | 12/1981 | Block et al. | 102/505 |
| 4,543,872 | 10/1985 | Graham et al. | 86/50 |
| 4,621,579 | 11/1986 | Badura et al. | 102/334 |
| 4,787,316 | 11/1988 | Drury et al. | 102/334 |
| 4,934,272 | 6/1990 | Sternin et al. | 102/334 |

FOREIGN PATENT DOCUMENTS

| | | |
|---|---|---|
| 0037515 | 10/1982 | European Pat. Off. . |
| 0106334 | 4/1984 | European Pat. Off. . |
| 0164732 | 12/1985 | European Pat. Off. . |
| 0221469 | 5/1987 | European Pat. Off. . |
| 8336148 | 4/1984 | Fed. Rep. of Germany . |
| 3312169 | 10/1984 | Fed. Rep. of Germany . |
| 3830142 | 3/1990 | Fed. Rep. of Germany . |
| 3835887 | 5/1990 | Fed. Rep. of Germany . |
| 495195 | 10/1919 | United Kingdom . |
| 861725 | 2/1941 | United Kingdom . |

*Primary Examiner*—David H. Brown

*Attorney, Agent, or Firm*—Scully, Scott, Murphy & Presser

[57] ABSTRACT

A camouflage and deception arrangement, which is especially adapted for practice purposes, and which incorporates a hollow member for the formation of a smoke screen. The hollow member is equipped with collapsible sidewalls intermediate a base plate and a cover plate thereof, and with at least one hollow plate provided with apertures for the swirling or turbulent movement of floating or suspended materials, and wherein the hollow plate is connected to a fluid source. Pursuant to the foregoing, there is contemplated the provision of a camouflage and deception simulator in the shape of a visually and sensorally most possibly permeable, collapsible casing which is inflatable into a geometrically specified hollow member, in which materials of specified sensoric attitude are maintained through a constant swirling or turbulence in a localized and over periods of time-defined, controlled suspended or floating condition.

11 Claims, 2 Drawing Sheets

CAMOUFLAGE AND DECEPTION ARRANGEMENT

BACKGROUND OF THE INVENTION

1. Field of the Invention

The present invention relates to a camouflage and deception arrangement, which is especially adapted for practice purposes, and which incorporates a hollow member for the formation of a smoke screen.

2. Discussion of the Prior Art

Measures of the type considered herein with respect to such an arrangement are generally known from the disclosure of published PCT Appln. PCT/EP 88/00378 (WO 89/01926) whereby a camouflaging smoke screen or fog which is particularly adapted for practice purposes, and which is constituted from non-toxic aerosols stored as a concentrated mixture in a supply canister, can be released through the activation of an igniting mixture. The expulsion of such a special practice mixture; in particular with consideration given to the typical sensor-response attitudes of real installations which are equipped with active or passive bearing or position-finding devices; however, does not adequately conform with the conditions which are actually encountered in a military application. Thus, it is possible to admix chaff-like particles with the pyrotechnic smoke-forming mixture, which act either actively or passively within specified ranges of the electromagnetic radiation spectrum and thereby controllably influence the camouflaging and deceptive effect of the smoke cloud; for example, as is disclosed in European Laid-Open Patent Appln. 0 103 334 or German Laid-Open Patent Appln. 38 35 887. Nevertheless, such relatively heavy additive particles sink down rapidly out of the cloud to the ground, and as a result do not provide for the necessary training and practice operation and the at least quasi-stationarily sought-after camouflaging and deceptive effect. In addition thereto, there must be considered that the smoke cloud which is emitted for camouflage and deception purposes, will in accordance with the momentary air-flow conditions more or less rapidly lose the necessary density thereof and drift off; with the disadvantageous side effect that the expelled substances will uncontrollably subject thereto areas which are to be held free therefrom, and thereby possibly disturb or even endanger friendly troops.

The discharge of camouflage materials against any direct sighting or; in essence, for the deceiving or any kind of disruption in the function of sensors, which are in particular active within the range of the infrared energy and the millimeter-waves of the electromagnetic spectrum, is already resultingly demanding in its need for material expenditures inasmuch as, in accordance with the presently encountered ground air currents, there must be emitted considerably large quantities of material over lengthier periods of time. Moreover, the contemplated repetitions for practice operations of specific stationary or time-dependent camouflage and deception situations can hardly be implemented in the open due to changing environmental conditions. Finally, most militarily employable camouflage materials possessed of an adequate degree of effectiveness and life expectancy within the radiation spectrum which are of interest are frequently enriched with toxic components, resulting in an endangering of the practicing troops or crews, as well as in a contamination of the environment.

SUMMARY OF THE INVENTION

In recognition of these conditions, i is accordingly an object of the present invention to provide a camouflage arrangement of the above-mentioned type with is also adapted for purposes of deception, which is harmless to the environment and is thus especially militarily employable for probing investigations, field tests, practicing operations and training tasks, inasmuch as it is sufficiently stable locally and over periods of time, and concurrently can be repeatedly employed simultaneously for training and practicing operations and, notwithstanding exerting a real effect on the sensors, is inexpensively obtainable.

The foregoing object is inventively attained in that the arrangement pursuant to the invention as described hereinabove has the hollow member equipped with collapsible sidewalls intermediate a base plate and a cover plate thereof, and with at least one hollow plate provided with apertures for the swirling or turbulent movement of floating or suspended materials, and wherein the hollow plate is connected to a fluid source. Pursuant to the foregoing, there is contemplated the provision of a camouflage and deception simulator in the shape of a visually and sensorally most possibly permeable, collapsible casing which is inflatable into a geometrically specified hollow member, in which materials of specified sensoric attitude (such as opaque smoke materials, aerosols, or radar-damping heavy gases, as well as radar wave-reflecting metal particules) are maintained through a constant swirling or turbulence in a localized and over periods of time-defined, controlled suspended or floating condition. The inventive arrangement, as needed in accordance with the actual military application for field tests or training operation, is erected in front of preselected terrain regions as a stationary screening and can also again be retracted. Hereby, even the behavior over a period of time of an expanding cloud of camouflage material can be imitated through an increasing inflation of one or more casings. For a screening of larger terrain regions or; in essence, for the imitation of a withdrawing cloud of camouflage material, without requiring operation of apparatus for the specified release of actually withdrawing clouds (referring to EP-OS 0 221 469 or EP-OS 0 164 732), a plurality of such types of inventive simulator arrangements can be installed adjacent to each other and inflated or alternatively again evacuated, staggered over a period of time. The sensor-specific permeability of a casing filling, as in a smoke cloud which is really to be formed in the open (referring to EP-OS 0 037 515 or EP-OS 0 106 334), can be varied through the type and quantity of the gas particles which are introduced into the inflatable casing and also any other heavier floating or suspended materials which constantly swirl therein and thereby remain in suspension. Moreover, certain training cycles allow themselves to be repeated under reproducible conditions. On the other hand, such a training camouflage simulator can also be employed as a deception simulator in order to mirror the enemy reconnoitering a specified target; namely, through a certain geometric millimeter-wave reflective beam cross-section pursuant to the extent of the turbulence geometry which is carried out in the arrangement. Also utilizable is a thermally-active gas filling.

The individual elements of such a geometrically complex arrangeable simulator, at an evacuated casing, can be folded together into an easily handable transport packet, which need merely be unfolded at the location of its intended use, and which is to be connected to a fluid source, as well as to a dispenser for the floating or suspended particles which are to be swirled in turbulent movement. For effectuating the inflation of the casing and the swirling of the suspended particles, a compressor for the atmospheric air can be connected thereto; however, basically also a slow-burning; in effect, a pyrotechnic gas generator which is inflatable over a lengthier time period.

Thus, an inventive arrangement of this type can be utilized in an essentially greater multiplicity of applications in training and testing operation, as well as under combat conditions at a simpler handling than the target mock-ups which act either actively or passively while only responsive to specific sensors, such as are generally described in the publication Nurnberger Nachrichten of Oct. 24, 1989, page 15; or in German Laid-Open Patent Appln. 33 12 169 as helicopter-like structures equipped with heating covers or, as a rectangular block with metallic reflective walls.

BRIEF DESCRIPTION OF THE DRAWINGS

Additional alternatives and modifications, as well as further features of the inventions and attendant advantages thereof can now be readily ascertained from the following detailed description of an exemplary embodiment of the camouflage and deception arrangement, taken in conjunction with the accompanying drawings; in which.

DETAILED DESCRIPTION

Figure 2:
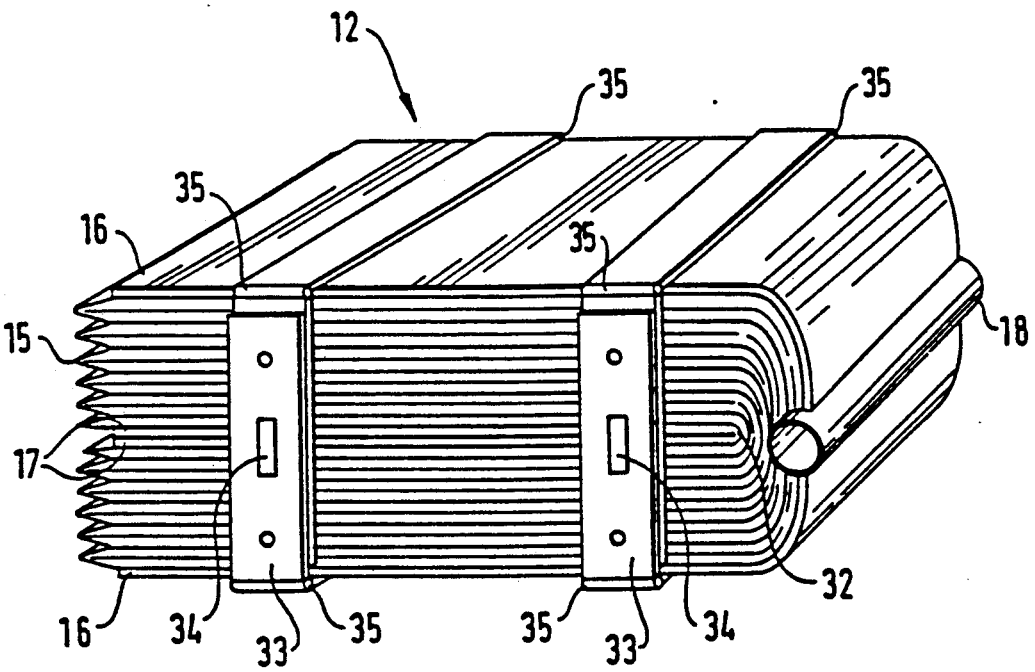
FIG. 2 illustrates the inventive arrangement of FIG. 1 shown in its folded and compact transport position.

The illustrated arrangement 11, which serves as a camouflage and deception simulator, possesses a flexible casing 12 which can be inflated into a hollow member 13 of generally the shape of a relatively narrow extended rectangular block. The sidewalls 14 thereof are preferably constructed from a compressible, transparent material for the operational-wavelength of specific sensors. The sidewalls possess accordion pleats 15 extending transversely of the vertical height of the hollow member 13. These pleats can either be preformed or constructed through the joining together of sidewalls 14 from individual strips; in any case, they support the stability in the shape of the inflated block; or for example, upon evacuation of the casing 12 provide a defined tight folding (as shown in FIG. 2). The sidewalls 14 extend between thicker base and cover plates 16, 17, which in contrast therewith are stiffer but are preferably also formed from a resiliently elastic plastic material. Arranged or formed in or on the base plate 16 is a pipe or tube connector 18, which possesses at least one wall opening 19 for he through-passage of a fluid medium employed for the filling and, respectively, evacuating of the internal space 20 of the rectangular block. Preferably the pipe connector 18 is arranged transversely of the longitudinal and vertical expanse of the block 13 in proximity with the base plate 16. In any case, it is connected to a hollow plate 21.1 which is pierced through like a shower head, and which preferably is similarly formed of flexible material, and which can rest on the base plate 16. This lower hollow plate 21.1; however, can also be formed in the base plate 16 itself when the latter is constructed hollow (in effect, in two layers) and is provided with apertures 22 communicating with the interior space 20 of the hollow member 13.

In order to be able to operate without the need for any regulating requirements with respect to the fluid source 23 which is connected to the filling pipe connector 18, and for the continuing swirling or turbulence of radiation-reflecting or absorbing particles 26 in the casing 12, the cover plate 17 is preferably provided with discharge apertures 24. These can be designed as pressure relief valves or simply as throttling locations, and preferably equipped with filters 25 for restraining any outflow of the introduced floating or suspended materials 26 which swirl in the interior space 20 of the casing due to the fluid flow out of the apertured plates 21.1; and are thereby constantly maintained in a suspended or floating condition within a geometrically defined space. In order to ensure such a swirling or turbulence of introduced floating or suspended material 26 taking place with the greatest degree of uniformity over the entire height of the hollow member 13, at least one further centrally apertured hollow plate 21.2 is located in the interior space 20, which through coiled or telescopic-like (FIG. 1 again shown by the bellows-pleat structure) stretchable hoses 27, are connected either directly or above the lower hollow plate 21.1 to the pipe connectors 18 and as a result to the external fluid source 23. Through subjecting the stretchable hoses 27 to pressure, the middle hollow plate 21.2 is raised into its operative position so as to, by means of its openings 22, subject the upper area of the interior space 20 of the rectangle block 13 to a turbulent flow.

For the fluid source 23 there can be connected to the pipe connectors 18 a replaceable cartridge of a continually afterblowing, for instance, pyrotechnic gas generator, preferably; however, a compressor 28 for atmospheric air, which maintains the interior space of the casing under a slight superatmospheric pressure, and which maintains the particles from a suspension material-cartridge 31 under a constant turbulence above the apertured plates 21.1 and 21.2 quasi-stationarily in the floating or suspended condition. Through a suitable dimensioning of the individual flow cross-sections; especially with regard to the hollow plate-apertures 22 and the outlet apertures 24, however, also in the raising or expansion hoses 27 as well as any direct through-openings 19 between the filling connects 18 and the interior space 20 of the casing, there can be constructively specified within certain limits, the manner in which the hollow member 13 will unfold during the inflation thereof; in effect, for example, whether there is initially raised a middle hollow plate 21.2 with the cover plate 17 which still rests thereon, or possibly whether there is initially raised the cover plate 17 away from a movable hollow plate 21.2 which is positioned therebelow.

In order to be able to again fold down the simulator, a compressor 28 which is provided as the fluid source 23 can be reversed, or for instance, a suction pump 29 can be connected to the pipe connectors 18. As a result thereof, the rectangular internal space 20 is rapidly evacuated such that the cover plate 17, the interposed middle hollow plate 21.2 as well as the folded in sidewalls 14, will position themselves on the lower hollow plate 21.1, or respectively, base plate 16. The suspended materials 26 which do not remain therebetween are filtered out in a separator 30 so as to be able to be reused during the next erection of this arrangement 11.

Figure 1:
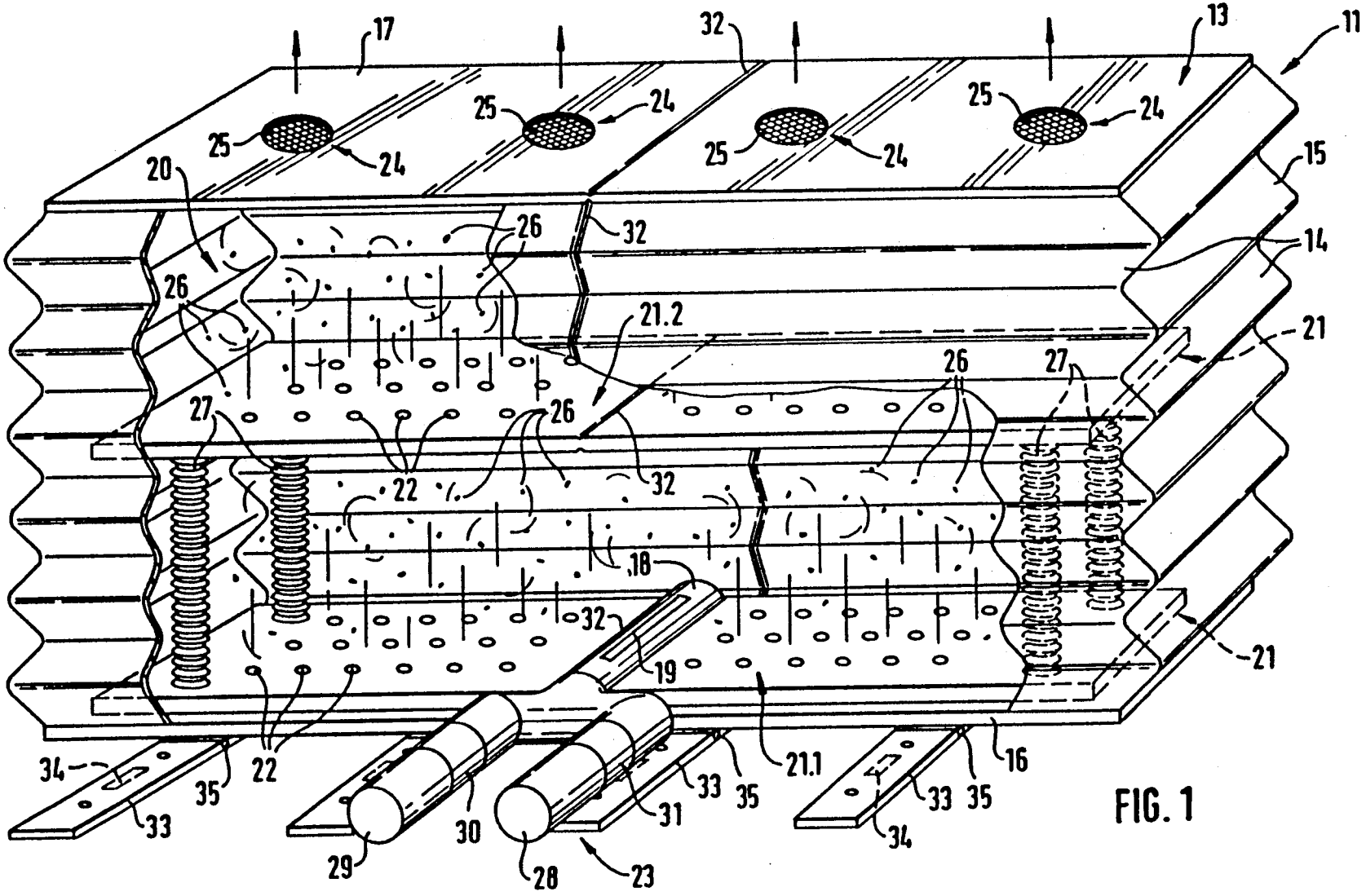
FIG. 1 illustrates an inventive camouflage and deception simulator which is especially employable for practice purposes, shown in the operative position thereof.

Expediently, the cover plate, hollow plates and base plate 17, 21.1 21.2, 16 are divided along specified bending or folding locations 32 and hingedly connected to each other and, respectively, to the pipe connectors 18. Thus, the sunken casing 12, upon the fluid source 23 being detached, can be folded along these locations 32 about the pipe connectors 18 into a handy, easily transportable packet (as shown in FIG. 2). Hereby, latchable supporting legs 32 which are extendable transversely of the longitudinal extent of the wall-like rectangular block 13, (as shown in FIG. 1), are swung up along the outside of this packet and connected with each other by means of latching devices 34 in order to maintain the compacted volume of the folded casing 12 in shape.

In order to employ the simulator, these latching devices 34 need merely be released, the supporting legs 33 swung towards the side about their hinges 35 with the base and latched, as well as the casing 12 being swung open from about the pipe connectors 18, so that after the connection of the fluid source 23 (preferably with specified suspended materials 26 swirling therethrough) it is inflated into the hollow member 13. When a plurality of such simulators are unfolded adjacent each other, then a sequenced control of their fluid sources 23 can be activated in such a manner that their cover plates 17 are raised in succession and again lowered; such that form a distance there is gained the impression of a cloud expanding or rising wavelike from the ground. This facilitates, even with simple means, the simulation of moving targets or, respectively, target signatures, in that this permits the movement of the volumes of the hollow members to be correspondingly reduced over a period of time and in a localized manner. In accordance with the type of gas and/or suspended material fillings of these neighboringly arranged variable hollow member 13, there can thus be produced a target camouflaging with respect to optronic, thermal and/or millimeter-wave and radar sensors (not shown in the drawing), or there can also be simulated a target structure or, respectively, a target signature.

What is claimed is:

1. Camouflage and deception arrangement, including a hollow member for the formation of a smoke screen, said hollow member including sidewalls foldable intermediate a base plate and a cover plate, communicating with the interior of said hollow member for introducing a flow of a pressurized fluid so as to inflate and maintain said hollow member in an expanded condition; and means for introducing particulate materials into said hollow member and maintaining a turbulent and substantially uniformly dispersed floating condition of said materials within said hollow member by said flow of pressurized fluid.

2. Arrangement as claimed in claim 1, wherein said fluid source comprises a compressor connected to atmospheric air.

3. Arrangement as claimed in claim 1, wherein said means for introducing particulate materials includes a particle dispenser for radiation-reflecting or radiation-damping particulate materials connected to said hollow member.

4. Arrangement as claimed in claim 1, wherein a suction pump is connected to the hollow member; and a separator interposed between said suction pump and said hollow member for retaining said particulate materials in the region of said separator upon evacuation of said fluid from said hollow member.

5. Arrangement as claimed in claim 1, wherein said cover plate includes outlet apertures for fluids, and means in said outlet apertures for inhibiting the egress of said suspended materials.

6. Arrangement as claimed in claim 1, wherein said hollow member is rectangular in configuration and is inflatable into an extended rectangularly-shaped simulator having specified folding pleats in said sidewalls extending transversely of the height of said member.

7. Arrangement as claimed in claim 1, wherein at least one intermediate apertured hollow plate is disposed between said base plate and is connected to said fluid source through hoses of extendable lengths so as to be in spaced relationship from said plates upon inflation of said hollow member.

8. Arrangement as claimed in claim 1, wherein a lower hollow plate is formed on the base plate, said lower hollow plate having apertures therein communicating between said fluid source and the interior of said hollow member.

9. Arrangement as claimed in claim 1, wherein the plates extend in parallel with the surface of the ground and are provided with specified bending locations which are foldable together at least in half along the casing at an evacuated internal space thereof and with folded sidewalls.

10. Arrangement as claimed in claim 1, wherein supporting legs are hingedly connected to the base plate, said supporting legs being latchable to each other in the folded condition of said hollow member.

11. Arrangement as claimed in claim 1, wherein said base plate comprises a hollow plate having apertures communicating between said fluid source and the interior of said hollow member.

* * * * *

UNITED STATES PATENT AND TRADEMARK OFFICE

CERTIFICATE OF CORRECTION

PATENT NO. : 5,094,168

DATED : March 10, 1992

INVENTOR(S) : Klaus Rumer

It is certified that error appears in the above-identified patent and that said Letters Patent is hereby corrected as shown below:

Column 1, line 33: "Appln. 0 103" should read as --Appln. 0 106 334--

Column 2, line 30: "paricules" should read as --particles--

Column 4, line 50: "connects" should read as --connectors--

Column 5, line 29: "form" should read as --from--

Column 5, line 48, Claim 1: "plate, communicating" should read as --plate, a fluid source communicating--

Signed and Sealed this

Tenth Day of August, 1993

*Attest:*

*Attesting Officer*

Michael K. Kirk

MICHAEL K. KIRK

*Acting Commissioner of Patents and Trademarks*